US008418706B2

(12) United States Patent
Weber

(10) Patent No.: US 8,418,706 B2
(45) Date of Patent: Apr. 16, 2013

(54) ERGONOMIC CRUTCH

(75) Inventor: Jeffrey A. Weber, Golden Valley, MN (US)

(73) Assignee: Mobi, LLC, Minneapolis, MN (US)

( * ) Notice: Subject to any disclaimer, the term of this patent is extended or adjusted under 35 U.S.C. 154(b) by 0 days.

(21) Appl. No.: 12/944,330

(22) Filed: Nov. 11, 2010

(65) Prior Publication Data

US 2011/0108075 A1 May 12, 2011

Related U.S. Application Data

(60) Provisional application No. 61/260,250, filed on Nov. 11, 2009.

(51) Int. Cl.
*A61H 3/02* (2006.01)

(52) U.S. Cl.
USPC ..... 135/72; 135/73; 135/66

(58) Field of Classification Search ..... 135/66, 135/68, 71, 72, 73, 76
See application file for complete search history.

(56) References Cited

U.S. PATENT DOCUMENTS

| | | | | |
|---|---|---|---|---|
| 1,137,008 | A | | 4/1915 | Kindermann |
| 1,241,815 | A | | 10/1917 | Blackard |
| 2,362,642 | A | | 11/1944 | Lamb |
| 2,408,604 | A | | 10/1946 | Brickson |
| 2,429,409 | A | | 10/1947 | Eidman |
| 2,547,265 | A | | 4/1951 | Hilgeman |
| 2,552,902 | A | | 5/1951 | Martin et al. |
| 2,568,654 | A | | 9/1951 | Neptune |
| 3,417,765 | A | | 12/1968 | Raymond et al. |
| 4,637,414 | A | | 1/1987 | Urban |
| 4,711,261 | A | | 12/1987 | Rosenberg |
| 4,899,771 | A | | 2/1990 | Wilkinson |
| 5,085,487 | A | | 2/1992 | Weingartner et al. |
| 5,197,501 | A | * | 3/1993 | Ragatz ..... 135/66 |
| 5,201,334 | A | | 4/1993 | Tseng |
| 5,301,704 | A | | 4/1994 | Brown |
| 5,331,989 | A | | 7/1994 | Stephens |
| 5,409,029 | A | | 4/1995 | Davis |
| 5,458,145 | A | | 10/1995 | Davis |
| 5,725,005 | A | | 3/1998 | Yamasaki et al. |
| 5,865,180 | A | * | 2/1999 | Sigfrid ..... 128/845 |
| 5,954,074 | A | | 9/1999 | Mattson |
| 6,085,766 | A | * | 7/2000 | Geary ..... 135/75 |
| 6,378,541 | B1 | | 4/2002 | Matthews |
| 6,494,919 | B1 | | 12/2002 | Matthews |
| D481,531 | S | | 11/2003 | Haythornthwaite |

(Continued)

FOREIGN PATENT DOCUMENTS

| | | | |
|---|---|---|---|
| JP | 6086793 | A | 3/1994 |
| JP | 2000126253 | A | 5/2000 |

(Continued)

*Primary Examiner* — Noah Chandler Hawk
(74) *Attorney, Agent, or Firm* — Pauly, Devries, Smith & Deffner, L.L.C.

(57) ABSTRACT

A method for upgrading a crutch, comprising the steps of providing a crutch having a leg, a first saddle, a first handle and a first foot; providing a second saddle different from the first saddle; removing the first saddle from the leg; and attaching the second saddle to the leg, wherein the first saddle has an upper surface that is symmetric about two planes and wherein the second saddle has an upper surface that is symmetric about only one plane, and certain crutches to use therewith.

4 Claims, 14 Drawing Sheets

U.S. PATENT DOCUMENTS

| | | | | |
|---|---|---|---|---|
| 6,772,778 | B2 * | 8/2004 | Morosini et al. | 135/65 |
| 6,851,438 | B2 | 2/2005 | Battiston | |
| 7,059,674 | B2 | 6/2006 | Garland et al. | |
| 7,357,139 | B2 | 4/2008 | Bonin, Jr. | |
| 7,360,547 | B2 * | 4/2008 | Carlson | 135/66 |
| 7,537,017 | B2 | 5/2009 | Baker | |
| D600,002 | S | 9/2009 | Fulkerson | |
| 7,712,479 | B2 | 5/2010 | Sundarrao | |
| 7,717,123 | B2 | 5/2010 | Weber | |
| 2007/0131264 | A1 * | 6/2007 | DeMay et al. | 135/71 |
| 2007/0144567 | A1 | 6/2007 | Haslach et al. | |
| 2008/0053502 | A1 | 3/2008 | Tseng | |
| 2008/0163914 | A1 | 7/2008 | Weber et al. | |
| 2008/0314426 | A1 | 12/2008 | Estrada, Jr. | |
| 2009/0159106 | A1 * | 6/2009 | Schulz et al. | 135/75 |
| 2009/0235966 | A1 | 9/2009 | Birnbaum | |
| 2009/0266392 | A1 | 10/2009 | Campbell | |
| 2010/0024857 | A1 | 2/2010 | Larson | |
| 2010/0051077 | A1 * | 3/2010 | McGann et al. | 135/76 |
| 2010/0071739 | A1 | 3/2010 | Cho | |
| 2010/0206348 | A1 | 8/2010 | Markou | |
| 2010/0269872 | A1 | 10/2010 | Tharp | |
| 2010/0288319 | A1 | 11/2010 | Luo | |
| 2011/0005559 | A1 | 1/2011 | Daily | |

FOREIGN PATENT DOCUMENTS

| | | | |
|---|---|---|---|
| WO | 8202490 | A1 | 8/1982 |
| WO | 2004047706 | A2 | 6/2004 |
| WO | WO2004047706 | | 6/2004 |

* cited by examiner

ERGONOMIC CRUTCH

This application claims priority to, and incorporates by reference Provisional Application No. 61/260,250 filed Nov. 11, 2009 and entitled Ergonomic Crutch.

This application also incorporates by reference U.S. Pat. No. 7,717,123 filed Jan. 10, 2007, and entitled Biomechanically Derived Crutch.

BACKGROUND

Crutches are used by millions of people each year recovering from lower-limb ailments such as broken bones, knee injuries and sprained ankles. The typical crutch most commonly used in the United States has several troubling features. Such a crutch has a saddle generally covered by a foam rubber pad, which is hot, sticky and causes under-arm skin abrasion, and a narrow horizontal handle that puts undo strain on the wrist by forcing it into a collapsed position. The typical crutch foot generally widens at the bottom and so catches under doors and ledges, making use more difficult. The typical crutch has a straight leg that angles out from the user, creating a wide stance that makes it more difficult to move through confined spaces such as crowds, doorways or hallways.

There is thus an ongoing need for a more comfortable and more usable crutch.

SUMMARY

The present invention pertains to a crutch that includes a leg, a saddle, a handle and a foot, where the saddle, handle and foot are removable and replaceably by a user. A first crutch, delivered to a user through a medical care facility or through another suitable channel, may include the leg, a first saddle, a first handle and a first foot. A second saddle, a second handle and a second foot might be made available through a suitable commercial channel for the user to purchase to replace the first saddle, handle and foot. The second set of components (i.e. saddle, handle and foot) may be made available individually or as a set. In one embodiment, each of the second set of components has different, and preferably superior features to each counterpart in the original set of components.

One embodiment pertains to an arcuate crutch that may include an elastomeric saddle disposed on a curved leg. The saddle includes a resilient elastomeric material disposed over a frame pivotably attached to the leg. The elastomeric material may be an oriented polymer. The frame of the saddle may flex with the weight of the user to spread outwards and provide greater contact area with the user and to help the saddle stay with the user during use. The saddle may be removably attached to the leg and may include a suspension system. The leg may be curved outwardly to accommodate the shape of the user while maintaining a narrow footprint and curved to the front to properly position the handle. The leg may be adjustable and may include two or three sections that slide with respect to each other to accommodate users of various heights. The handle may be fixed to the leg and may extend back from the frame at an upward and outward angle to provide a natural and ergonomic position for the hand. The foot may include a curved bottom surface and may flex to provide cushioning and orientation. The foot may include a rigid interior frame and a more resilient or softer skin. The skin may cover the frame.

BRIEF DESCRIPTION OF DRAWINGS

The invention may be more completely understood in consideration of the following detailed description of various embodiments of the invention in connection with the accompanying drawings, in which.

Figure 1:
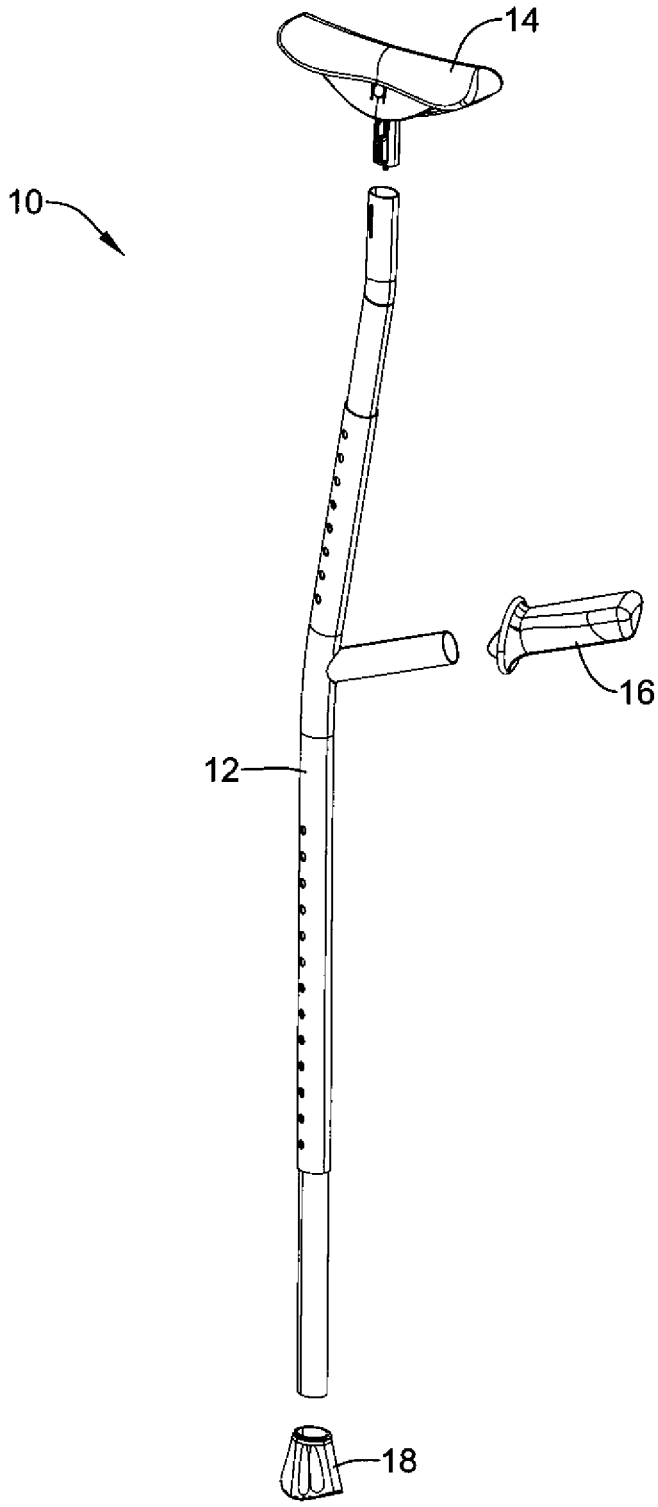
FIG. 1 is an exploded isometric view of an example crutch including the leg, saddle, handle and foot.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

Figure 2:
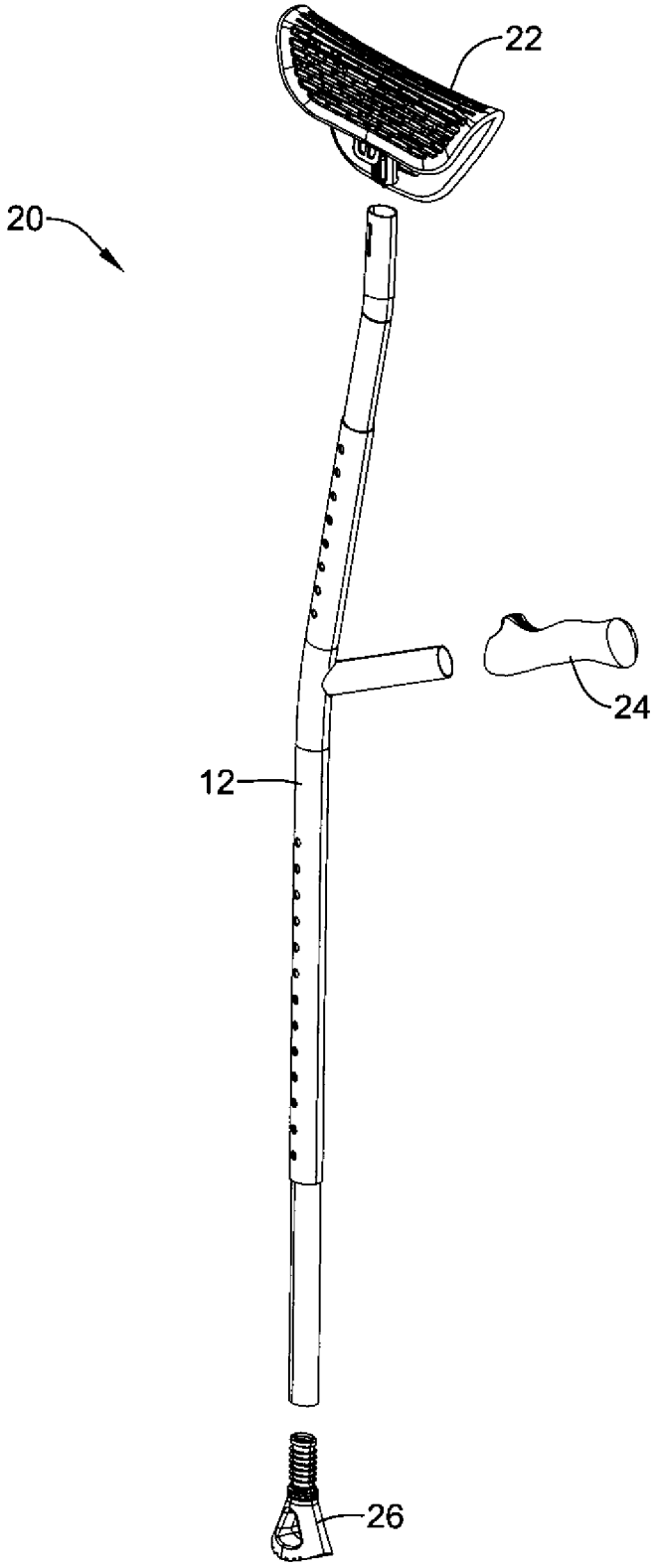
FIG. 2 is an exploded isometric view of another example crutch including the leg, saddle, handle and foot.

An example crutch 10, shown in FIG. 1, includes a leg 12, a saddle 14, a handle 16 and a foot 18. Each of the leg, saddle, and handle may be fixed to the frame or may be removably attached to the frame. Crutch 10 is a handed crutch and is configured for optimal use with a particular hand and side of the body. The particular crutch 20 shown is a left-handed crutch, but references to crutch 10 should not be understood as limited to a crutch of a particular handedness. A right-handed crutch is omitted for the sake of simplicity, but it should be understood that the discussion herein is applicable to right-handed crutches, which are contemplated and which are in a mirror image of their left-handed counterparts. Further, it is anticipated that the crutches disclosed herein may and often will be packaged in a set including a left-handed crutch and a right-handed crutch. Still further, some embodiments and features of the present invention are not limited to handed crutch and may be used in conjunction with crutches or other devices that are equally suited to use with either hand. FIG. 2 illustrates a second crutch 20. Crutch 20 may include a leg 12, a saddle 22, a handle 24, and a foot 26. It is contemplated that the components herein discussed may be exchanged as desired. For example, any of the saddles 14,22, handles, 16, 24 or feet 18, 26 may be used with other suitable legs and any suitable combination of components may be used in the same crutch. For example, a crutch (not shown) may include a leg 12, a saddle 22, a handle 24 and a foot 18.

Figure 3B:
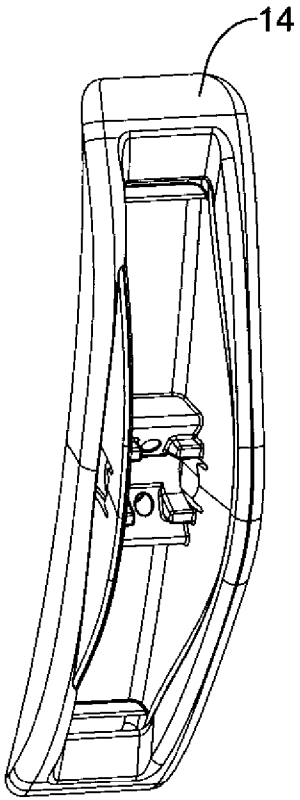
FIG. 3B is a bottom isometric view of a portion of the saddle of the crutch of FIG. 1.
Figure 3A:
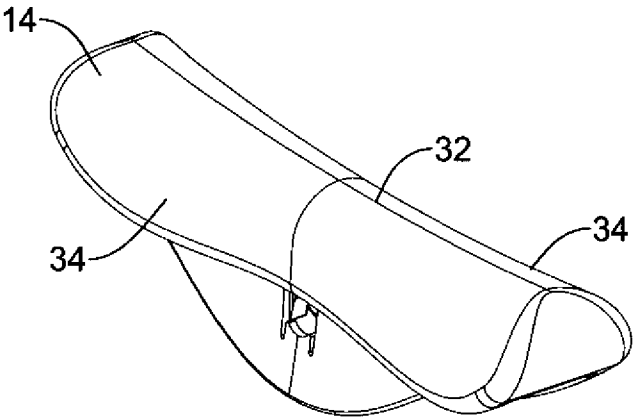
FIG. 3A is a top isometric view of the saddle of the crutch of FIG. 1.
Figure 4B:
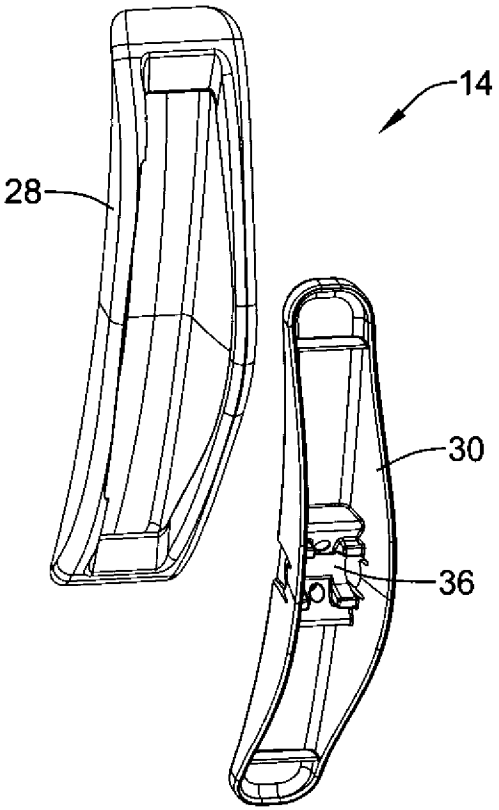
FIG. 4B is a bottom isometric exploded view of the saddle of the crutch of FIG. 1.
Figure 4A:
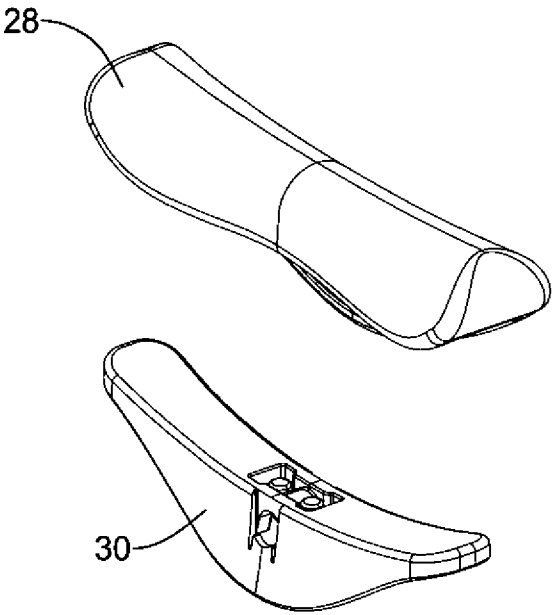
FIG. 4A is a top isometric exploded view of the saddle of the crutch of FIG. 1.

FIGS. 3A and 3B are top and bottom isometric views of saddle 14. Saddle 14 may have a top surface 32 that is symmetric in two planes. The two planes of symmetry may be vertical planes that are perpendicular to each other. The top surface 32 may be curved in a slightly convex fashion along its length and may include side surfaces 34 that are slightly concave to accommodate a user's chest, arm and armpit. FIGS. 4A and 4B are exploded views of saddle 14 that illustrate the two principle components of the saddle, a resilient component 28 and a rigid frame component 30. Preferably, the resilient component 28 defines the entire top surface 32 of the saddle 14 and extends over the sides of the frame component as shown such that, during normal use, the frame component is isolated from the user's arms and chest. The resilient component 28 may include a closed-cell foam or other suitable material and may be adhesively fixed to the frame component.

The saddle 14 preferably includes a pivot joint 36 that allows it to rotate on a vertical axis extending up through the leg. The extent of rotation may be 15, 20, 22, 25, 30, or 35 degrees or another suitable rotational extent. This vertical rotation allows the angular position of the saddle to be adjusted with respect to the rest of the crutch, and in particular the handle, to allow the crutch to better adapt to various unique user body shapes (the arm pit-to-hand angle varies between people). In another suitable embodiment joint 36 may be fixed so as not allow rotation of the saddle about a vertical axis or may be adjustably fixed so as to allow a user to customize the orientation of the saddle 14 with respect to the leg 12. Saddle 14 also preferably includes a horizontal pivot. The horizontal pivot is about an axis normal to the longest horizontal dimension of the saddle. The horizontal pivots may allow the saddle to rock about this axis during use to reduce or eliminate scrubbing action of the saddle against the user's chest and arms. This horizontal rocking may be controlled with one or more springs positioned to bring the saddle back to a neutral position. In some embodiments, joint 36 may allow horizontal rocking as described while being fixed or adjustably fixed about the vertical axis as described above.

Figure 5:
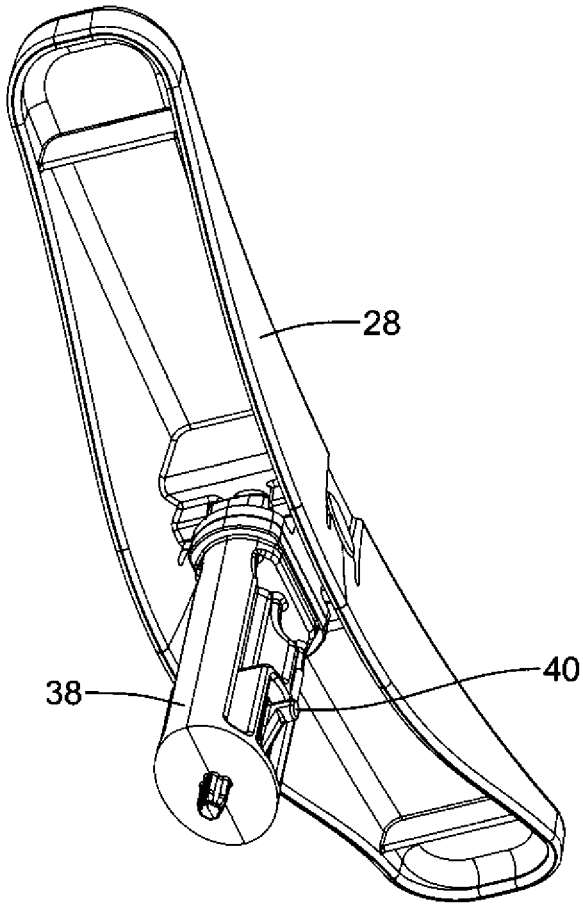
FIG. 5 is a bottom isometric view of a portion of the saddle of the crutch of FIG. 1 and the stem that joins the saddle to the leg.

FIG. 5 illustrates a preferential method of attaching the saddle 14 to a leg such as leg 12. The saddle, through joint 36, is attached to a stem 38. Stem 38 includes a resilient and depressible tab 40 that fits into a slot provided on the crutch leg. The saddle 14 may be removably attached to a crutch leg 12 by inserting the stem 38 into the top of the crutch leg. Tap 40 may be depressed to allow the user to pull the saddle from the leg. Of course, another suitable attachment system may be used.

Figure 6B:
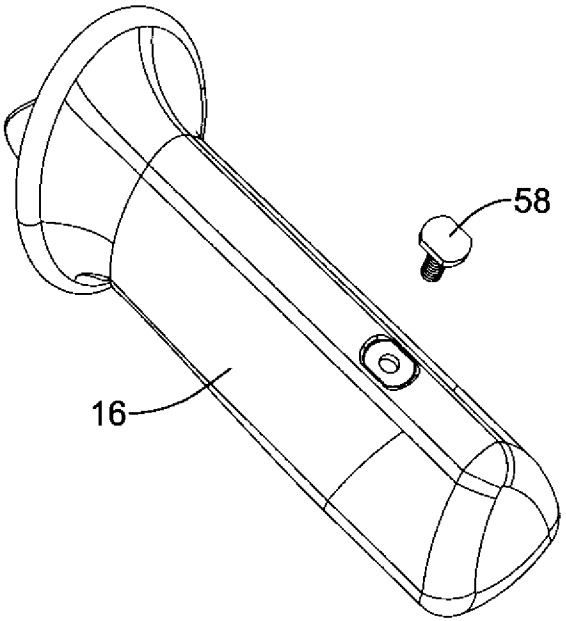
FIG. 6B is a view showing the bottom of the handle of the crutch of FIG. 1.
Figure 6A:
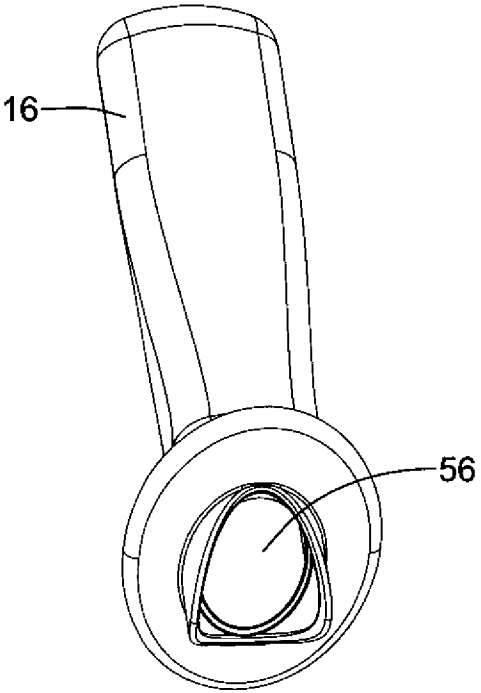
FIG. 6A is a view showing the top of the handle of the crutch of FIG. 1.
Figure 7:
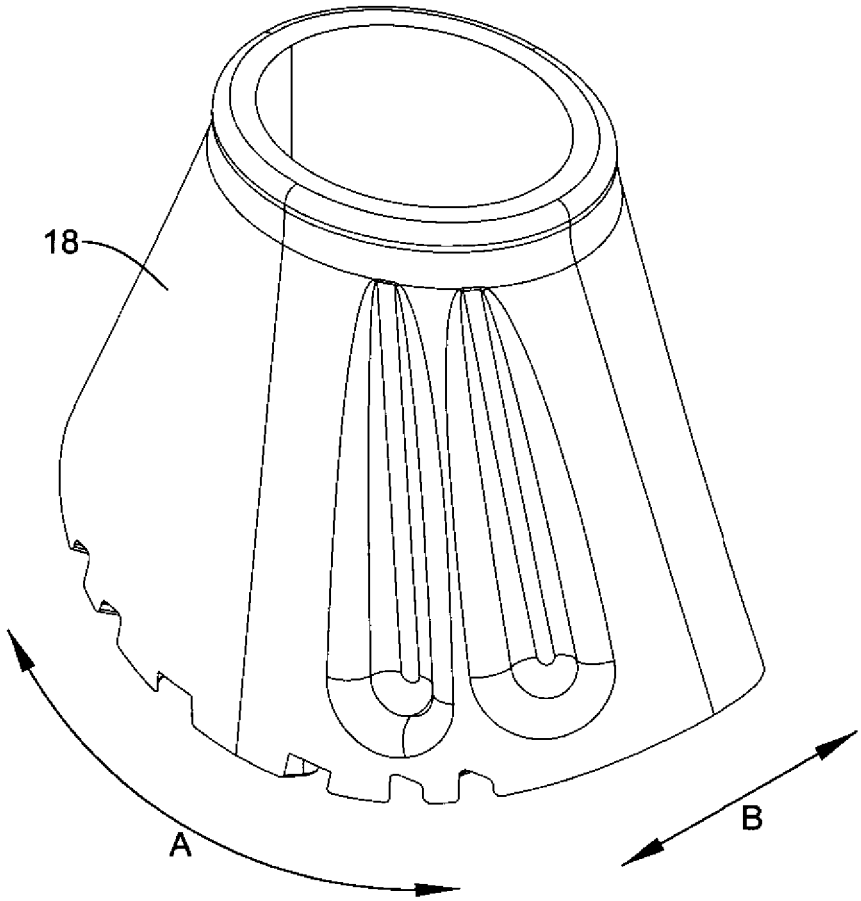
FIG. 7 is a view of the foot of the crutch of FIG. 1.
Figure 8:
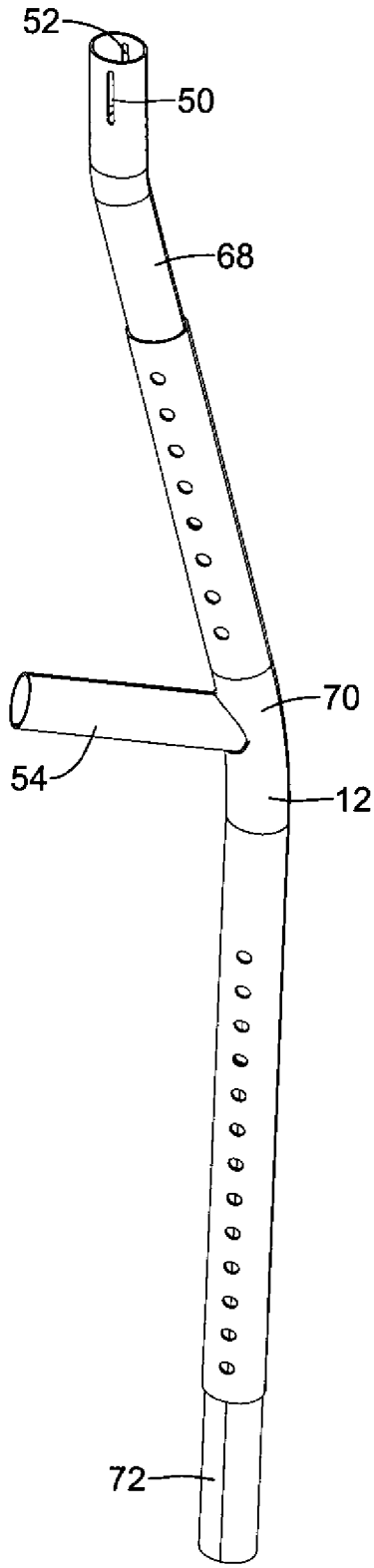
FIG. 8 is a view illustrating a crutch leg.

FIGS. 6A and 6B are top and bottom views of handle 16. Handle 16 includes an opening 56 that extends through a substantial length of the handle. Handle 16 is attached to the leg by sliding the leg over a cantilevered arm 54 fixed to the leg. It is contemplated that the cantilevered arm 54 provides most of the structural support for the handle 16, while the handle 16 is made from a non-abrasive resilient closed-cell foam or other suitable material to provide a comfortable grippable surface for the use. The handle 16 preferably may include a fastener 58 such as a screw or Christmas tree fastener to fix the handle 16 to the cantilevered arm 54. Cantilevered arm 54 may include a hole for receiving the fastener. Opening 56 of handle 16 may have an oval or other non-circular cross-section and cantilevered arm 54 of the leg may have a corresponding shape such that the relationship of arm 54 to the opening prevents rotation of the handle 16. Of course, other stem and cavity configurations that do not have circular profiles may also provide a similar function. Handle 16 may also include tabs on either side that extend at least partially round the sides of the vertical portion of the leg to further oppose rotational force. Handle 16 is symmetric such that it is equally suitable for use by both a left hand and a right hand.

Foot 18 may be a natural rubber foot that slides over the bottom of the leg and is held in place by a friction fit. The foot 18 may have a contoured bottom surface that is curved in a front-to-back direction A and is flat in a side-to-side direction B. This allows the crutch to easily rock in a front-to-back direction and provides side-to-side stability. The crutch leg may have an oval or other non-circular cross-section and the foot may have a corresponding opening such that rotation of the foot is further prevented by the geometry of the crutch bottom and foot opening.

Leg 12 may includes an upper part 68, a central part 70 and a lower part 72. The upper part and the lower part may each be adjusted with respect to the central part to adjust the overall height of the crutch and to adjust the relative position of the handle. With this three-part arrangement, two crutches having the same heights may have different handle positions to accommodate differently shaped users. The adjustment mechanism includes a depressible tab on each of the upper and lower parts that each fits into a series of holes in the central part. The upper part may include one or more slots 50,52 to accommodate the handles. The central part includes an arm 54 for attaching the first and second handles. Each of the three parts preferably has an oval or other non-circular cross-section to prevent rotation of the parts with respect to each other. Further details of how a preferred leg may be shaped may be found in U.S. Pat. No. 7,717,112, filed Jan. 10, 2007, and entitled Biomechanically Derived Crutch, which has been incorporated by reference.

Figure 9B:
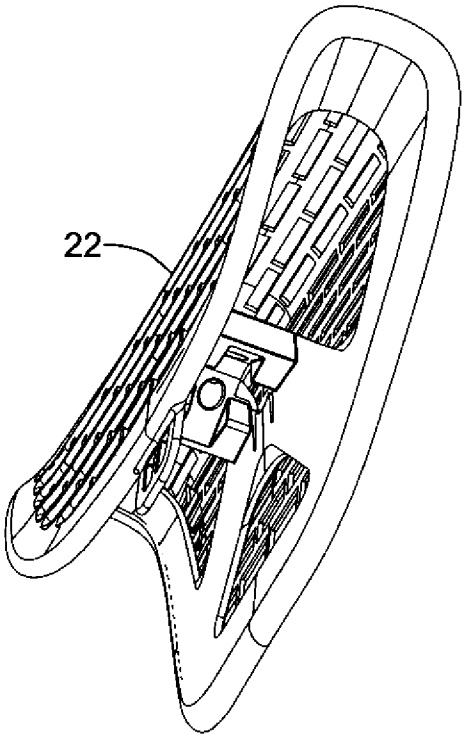
FIG. 9B is a bottom isometric view of the saddle of the crutch of FIG. 2.
Figure 9A:
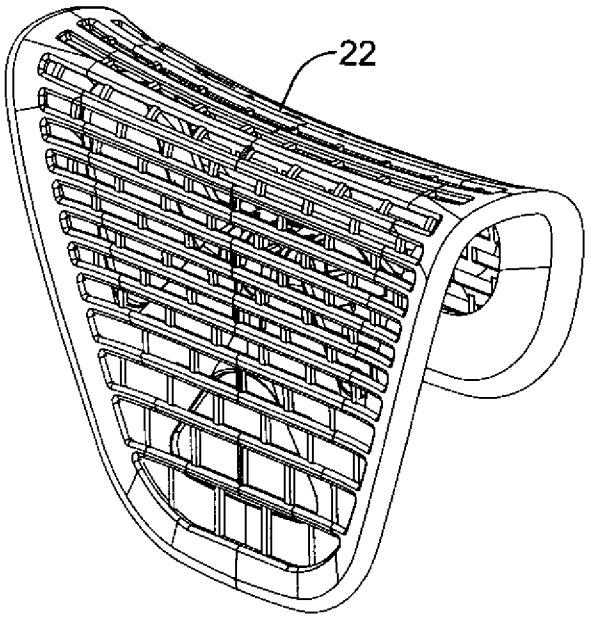
FIG. 9A is a top isometric view of the saddle of the crutch of FIG. 2.
Figure 10B:
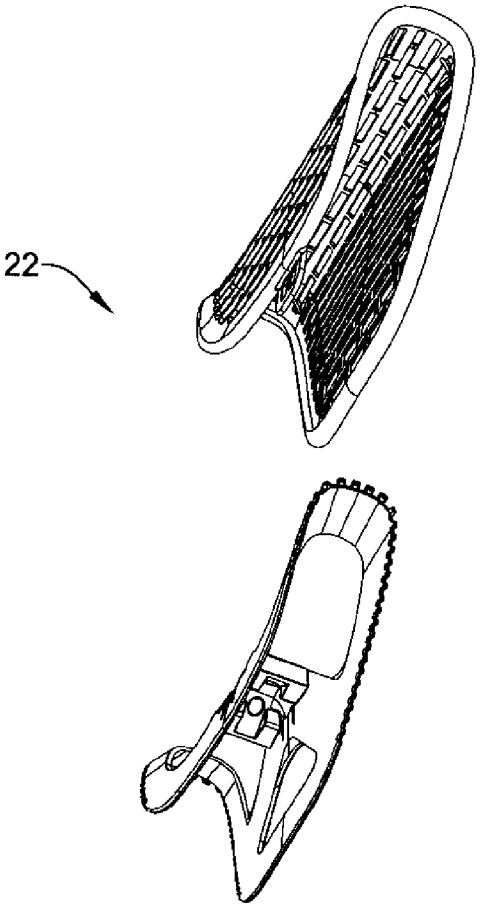
FIG. 10B is a bottom isometric exploded view of the saddle of the crutch of FIG. 2.
Figure 10A:
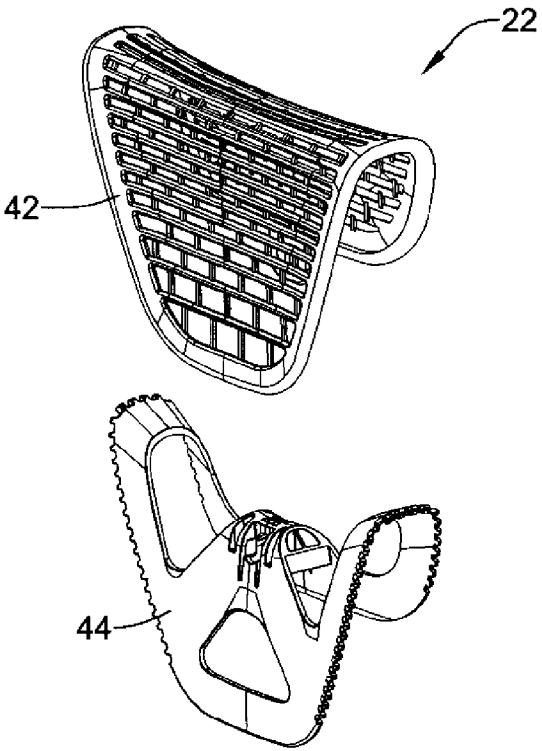
FIG. 10A is a top isometric exploded view of the saddle of the crutch of FIG. 2.
Figure 11:
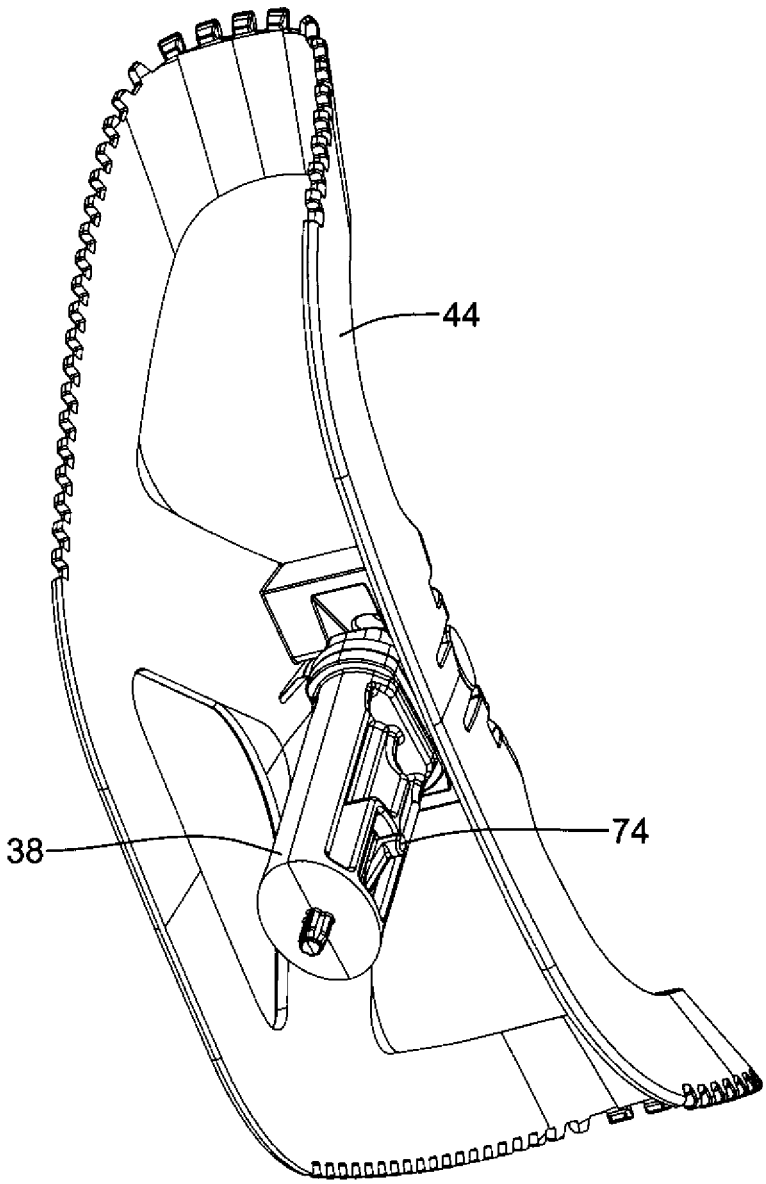
FIG. 11 is a bottom isometric view of a portion of the saddle of the crutch of FIG. 2 and the stem that joins the saddle to the leg.

FIGS. 9A and 9B are isometric top and bottom views of saddle 22, and FIGS. 10A and 10B are exploded isometric views of saddle 22. Saddle 22 may include an elastomeric molded member 42 that may be molded and then expanded to at least partially orient the polymeric molecules of the member 42. This member may be stretched and attached to a rigid perimeter frame 44 to provide the saddle shape. The member 42 preferably completely encloses the perimeter of frame 44 to isolate the frame from the user. Frame 44 has a hyperbolic paraboloid shape, with one lobe being larger than the other. The elastomeric molded member may include slits or other openings to allow for ventilation through the saddle. The perimeter frame is attached to a pivoting joint through a "W" shaped interior frame. Saddle 22 may include a joint such as joint 36 described above that allows the saddle to rock and/or to rotate or fixedly adjust about a vertical axis. As shown in FIG. 11, the saddle may attach to a leg 12 through a stem 38 and a resilient tab 74.

Figure 12:
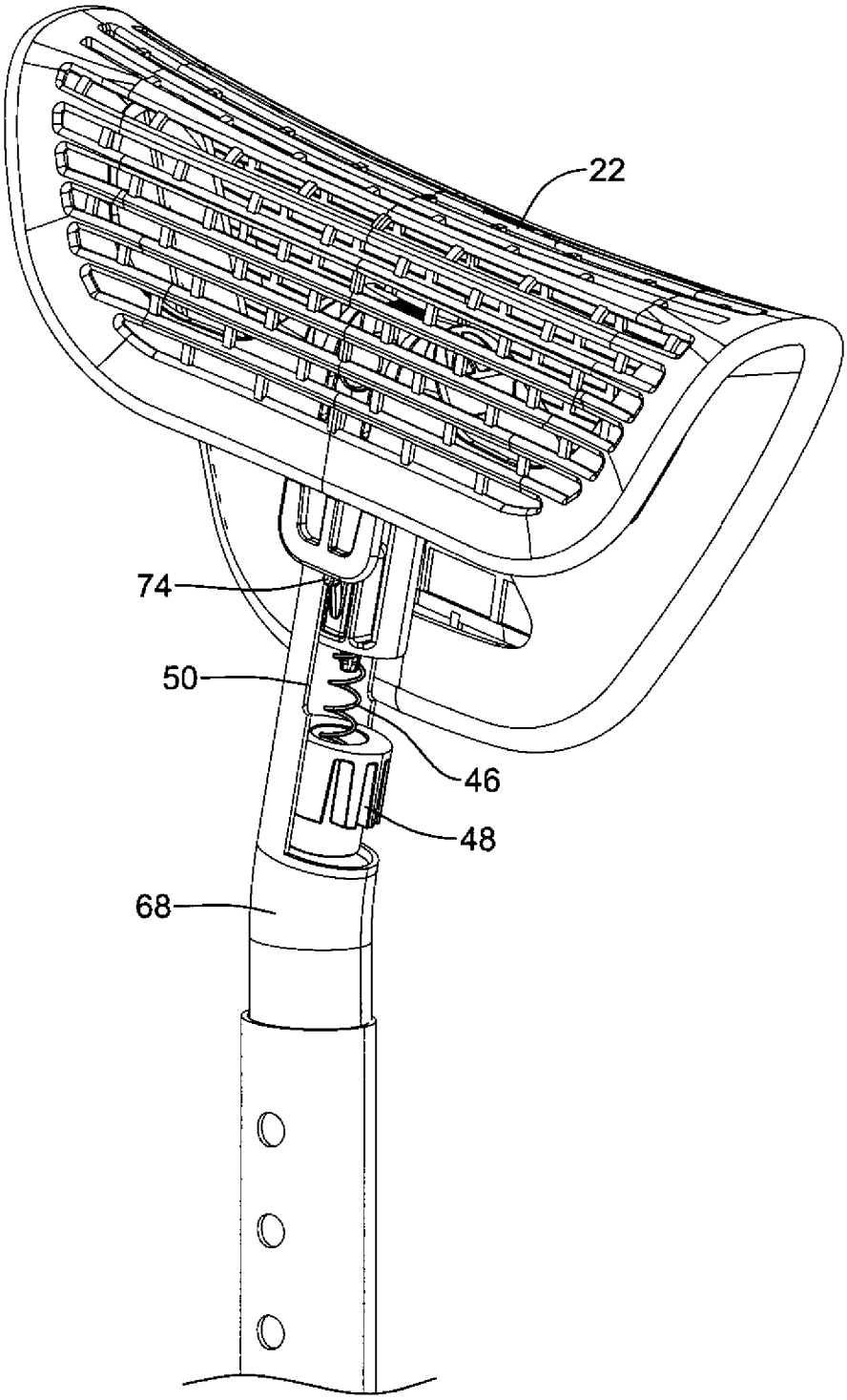
FIG. 12 is a partial cut-away view illustrating a suspension system that may be incorporated into a crutch such as that of FIG. 2.

FIG. 12 illustrates a a shock absorber-type spring mechanism that may be mounted between the upper section 68 of the leg and the stem 38. A spring 46 is captured between the stem 38 and a block 48. Block 48 is fixedly attached within the upper section 68 of the leg 12. A pin and slot mechanism 74, 50 may limit the extent of the travel of the saddle relative to the leg. The spring 46 may be slightly compressed by the spring mechanism even with no load on the crutch to provide a more solid crutch feel and reduced noise. Of course, spring mechanism 25 is illustrative and not limiting, and other shock-absorbing mechanisms may be used in alternate embodiments or the stem may be fixed relative to the leg.

Figure 13B:
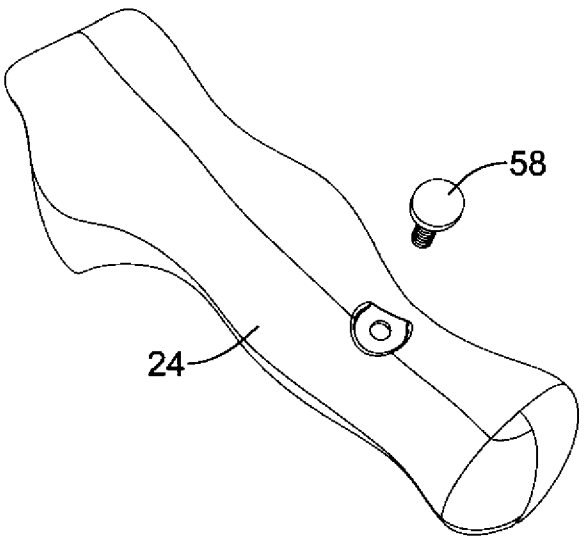
FIG. 13B is a view showing the bottom of the handle of the crutch of FIG. 2.
Figure 13A:
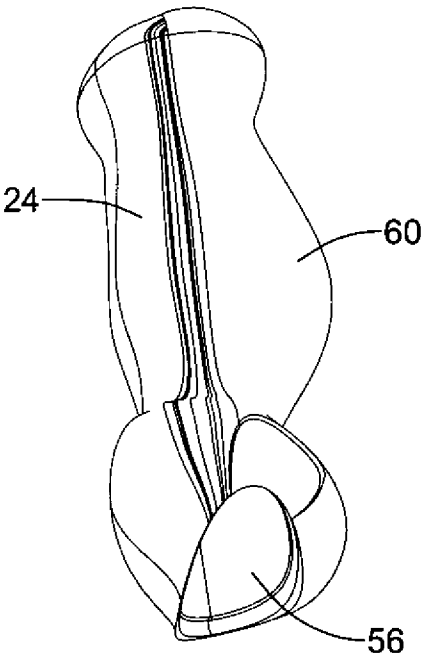
FIG. 13A is a view showing the top of the handle of the crutch of FIG. 2.

FIGS. 13A and 13B illustrate handle 24, which, apart from the differences discussed in this section, is the same as handle 16, described above. For example, handle 24 may include an opening 56 and fastener 58, which function as described above with respect to handle 16. The key difference from handle 16 is that handle 24 is handed; there is a right hand version of the second handle and a left hand version of the second handle. The second handle has a contoured grip 60 that provides a more neutral hand resting position to reduce stresses on the user's hand and wrist. In other respects, the second handle is similar to the first handle.

Figure 14:
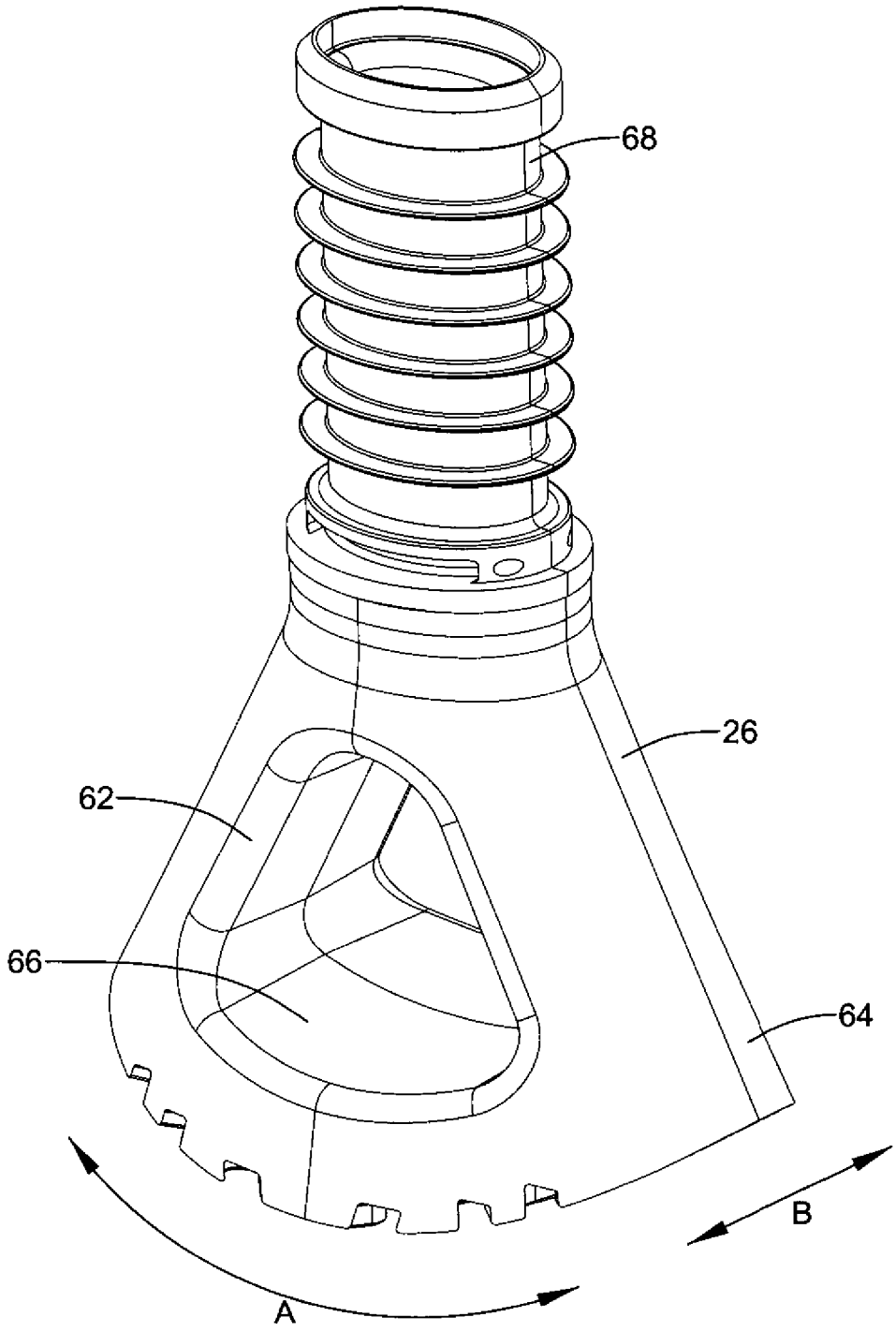
FIG. 14 is a view of the foot of the crutch of FIG. 1.

FIG. 14 illustrates the foot 26. Foot 26 may have a two-part structure with a rigid interior frame 62 and a softer skin 64 injected molded about the interior frame 62. The second foot has a similar curved bottom profile to that described above and has an opening 66 extending from side to side. The foot 26 may have a contoured bottom surface that is curved in a front-to-back direction A and is flat in a side-to-side direction B. Opening 66 allows foot 26 to partially resiliently collapse to provide more cushioning and a larger contact area with the floor. Foot 26 may be attached to the leg by a top stem 68 that fits into the hollow bottom of the leg or by another suitable mechanism. The top stem includes a coil or series of ridges that may partially collapse as the top stem is forced into the leg to secure the second foot to the leg. This functions similar to a Christmas tree fastener. The leg and the stem preferably have oval, rather than round, cross-sections to prevent rotation of the foot with respect to the leg. The rigid frame may have a "V" or "Y" configuration with first and second legs extending down opposite sides of the opening. A portion of the interior frame may extend into the stem 68. The interior frame 62 may include a third leg that extends between the bottom ends of the first and second legs, effectively surrounding the opening 66. The skin 64 may completely enclose the rigid frame 62 or may partially extend up the sides of the first and second legs. It is contemplated that the skin extends at least between the bottom ends of the first and second legs of the rigid frame and defines the bottom surface of the foot 26.

Having thus described the several embodiments of the present invention, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes may be made in details, particularly in matters of shape, size and arrangement of parts without exceeding the scope of the invention.

What is claimed is:

1. A method for upgrading a crutch, comprising the steps of providing a crutch having a leg, a first saddle, a first handle and a first foot, the first saddle comprising a frame and a resilient member, the frame having a perimeter with a hyperbolic paraboloid shape and the resilient member being an elastomeric molded member attached to the perimeter, wherein the first saddle is configured to be removable and replaceable by a user;

providing a second saddle different from the first saddle, the second saddle comprising a frame and a resilient member, the frame having a perimeter with a hyperbolic paraboloid shape and the resilient member being an elastomeric molded member attached to the perimeter, wherein the second saddle is configured to be removable and replaceable by a user;

removing the first saddle from the leg;

attaching the second saddle to the leg.

2. The method of claim 1 wherein the first saddle has an upper surface that is symmetric about two planes and wherein the second saddle has an upper surface that is symmetric about only one plane.

3. The method of claim 1 wherein the resilient member of the second saddle is breathable.

4. The method of claim 1, further comprising the steps of providing a second handle that is different from the first handle;

removing the first handle from the leg;

attaching the second handle to the leg.

* * * * *